US007814829B2

(12) United States Patent
Sugiyama

(10) Patent No.: US 7,814,829 B2
(45) Date of Patent: Oct. 19, 2010

(54) CYLINDRICAL BODY SUPPORTING DEVICE

(75) Inventor: Hiroyuki Sugiyama, Tokyo (JP)

(73) Assignee: Komori Corporation, Tokyo (JP)

( * ) Notice: Subject to any disclaimer, the term of this patent is extended or adjusted under 35 U.S.C. 154(b) by 1032 days.

(21) Appl. No.: 11/435,741

(22) Filed: May 18, 2006

(65) Prior Publication Data

US 2007/0119316 A1 May 31, 2007

(30) Foreign Application Priority Data

May 20, 2005 (JP) ..... 2005-147584

(51) Int. Cl.
*B41F 13/14* (2006.01)
*B41F 15/08* (2006.01)

(52) U.S. Cl. ..... 101/248; 101/216; 101/116; 101/479

(58) Field of Classification Search ..... 101/248, 101/116
See application file for complete search history.

(56) References Cited

U.S. PATENT DOCUMENTS 2,653,538 A 9/1953 Peyrebrune
3,565,001 A * 2/1971 Zimmer ..... 101/116
4,414,898 A * 11/1983 Westerkamp et al. ..... 101/248

FOREIGN PATENT DOCUMENTS

| | | |
|---|---|---|
| EP | 1 431 034 | 6/2004 |
| JP | 6-286104 A | 10/1994 |
| JP | 2004-99314 A | 4/2004 |

* cited by examiner

*Primary Examiner*—Leslie J Evanisko
(74) *Attorney, Agent, or Firm*—Birch, Stewart, Kolasch & Birch, LLP

(57) ABSTRACT

A cylindrical body supporting device includes a pair of holders for respectively supporting both end sides in an axial direction of a rotary screen cylinder, and a pair of first eccentric bearings for rotatably supporting the pair of holders. The cylindrical body supporting device also includes an adjusting screw, a spur gear, a spline gear, lateral motors and the like collectively used for moving the pair of holders through the pair of first eccentric bearings, and a control device for activating the lateral motors to allow the pair of holders to approach and recede along the axial direction and thereby to support and release the cylindrical body and for activating the lateral motors to synchronously move the pair of holders in an identical amount in the same direction along the axial direction and thereby to move the cylindrical body in the axial direction.

12 Claims, 15 Drawing Sheets

CYLINDRICAL BODY SUPPORTING DEVICE

BACKGROUND OF THE INVENTION

1. Field of the Invention

The present invention relates to a cylindrical body supporting device for drivably and rotatably supporting a cylindrical body, which is highly effective for use particularly in supporting a rotary screen cylinder of a rotary screen apparatus configured to perform screen printing on flat paper sheets.

2. Description of the Related Art

A plate cylinder of a printing press is required to be rotatable and replaceable, and is therefore configured to be supported by rotatable and drivable taper cones to be inserted into tapered holes formed on both end sides in an axial direction thereof (see, for example, Japanese Unexamined Patent Publication No. 6(1994)-286104).

Incidentally, a relative position with respect to an impression cylinder is extremely important in the above-described plate cylinder of a printing press. However, it has been extremely difficult to adjust a delicate deviation in that position.

Such a problem is not limited only to a device for supporting a plate cylinder of a printing press as described above, but is also apt to occur similarly in a cylindrical body supporting device for drivably and rotatably supporting a cylindrical body such as a device for supporting a rotary screen cylinder of a rotary screen apparatus configured to perform screen printing on flat paper sheets.

SUMMARY OF THE INVENTION

In this context, it is an object of the present invention to provide a cylindrical body supporting device which is capable of adjusting a delicate deviation in the position of a cylindrical body easily.

To solve the foregoing problem, the present invention provides a cylindrical body supporting device including a pair of supporting members for respectively supporting both end sides in an axial direction of a cylindrical body, a pair of first driving means for respectively moving the pair of supporting members along the axial direction, and controlling means for activating the pair of first driving means to allow the pair of supporting members to approach and recede along the axial direction and thereby to support and release the cylindrical body and for activating the pair of first driving means to synchronously move the pair of supporting members in an identical amount in the same direction along the axial direction in a state of supporting the cylindrical body and thereby to move the cylindrical body in the axial direction.

The present invention also provides the above-described cylindrical body supporting device, which further includes a pair of first bearing members for rotatably supporting the pair of supporting members respectively. Here, the first driving means move the supporting members along the axial direction through the first bearing members.

The present invention also provides the above-described cylindrical body supporting device, in which the first bearing members are configured to support the supporting members eccentrically, and the cylindrical body supporting device further includes second driving means for rotationally moving the first bearing members in a circumferential direction.

The present invention also provides the above-described cylindrical body supporting device, which further includes a second bearing member for eccentrically supporting one out of the pair of first bearing members, and third driving means for rotationally moving the second bearing member in a circumferential direction.

The present invention also provides the above-described cylindrical body supporting device, which further includes a power transmission member provided on one out of the pair of supporting members so as to regulate rotation in a circumferential direction relative to the supporting member and to enable motion in an axial direction and provided with helical teeth on an outer peripheral surface, which are meshed with a helical gear, and fourth driving means for moving the power transmission member meshed with the helical gear in the axial direction.

The present invention also provides the above-described cylindrical body supporting device, in which the cylindrical body is a rotary screen cylinder.

The present invention also provides the above-described cylindrical body supporting device, in which the first driving means includes an adjusting screw screwed into any one of the frame and the supporting member and loosely fitted to the other one of the frame and the supporting member so as to regulate motion in an axial direction relative to the other one of the frame and the supporting member, and a lateral motor for rotationally moving the adjusting screw.

The present invention also provides the above-described cylindrical body supporting device, in which the adjusting screw is provided with a head to be loosely fitted to the supporting member and is restricted to move in the axial direction relative to the supporting member while being screwed into the frame, and the first driving means includes a spur gear fitted coaxially to the head of the adjusting screw and a spline gear of a spur type meshed with the spur gear. Moreover, the lateral motor is connected to the spline gear and is fixed to and supported by the frame.

The present invention also provides the above-described cylindrical body supporting device, in which the fourth driving means includes a carrier member of which one end is fitted to the power transmission member, a screw shaft of which one end is supported in a rotationally movable manner by the carrier member, a worm wheel provided with a screw portion on an inner peripheral surface, into which the screw shaft is screwed, a worm meshed with the worm wheel, and a circumferential motor for rotating the worm.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PRESENT INVENTION

Preferred embodiments of the present invention will now be described below with reference to the accompanying drawings. It is to be noted, however, that the present invention will not be limited to the following embodiments.

First Embodiment

Figure 1:
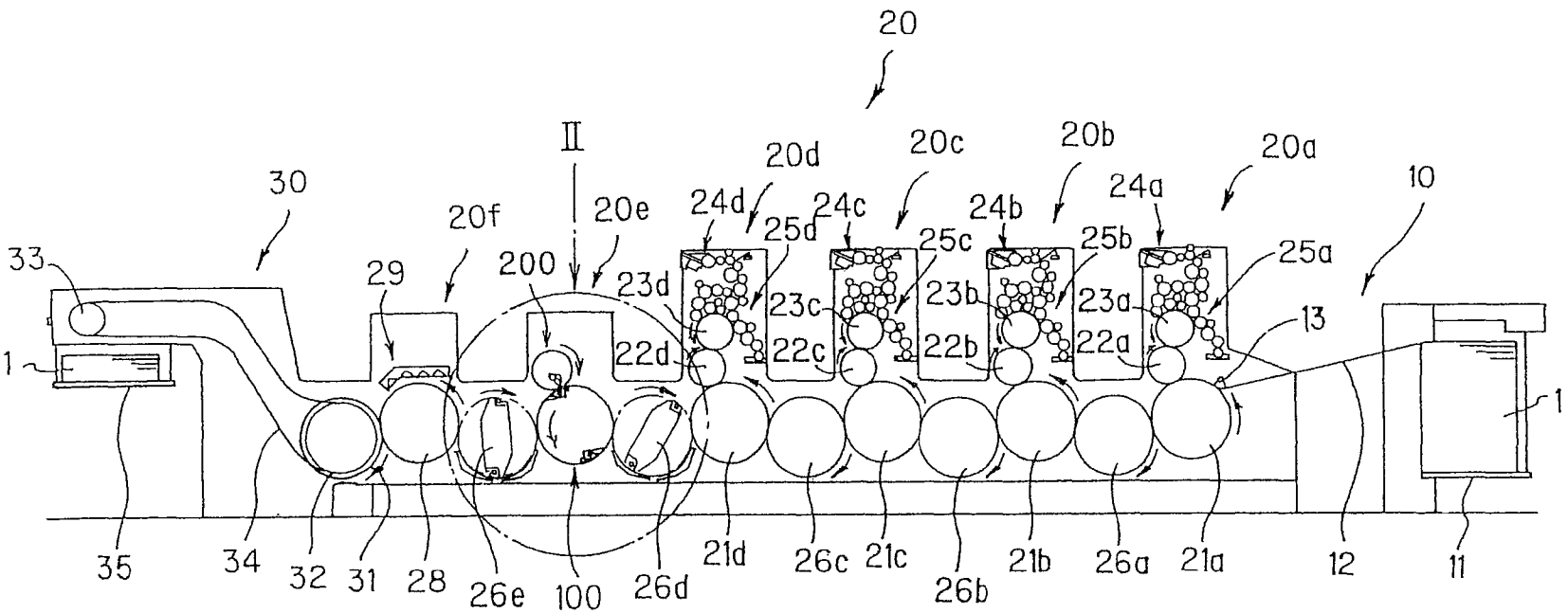
FIG. 1 shows an overall schematic structural drawing of a first embodiment showing a printing press which applies a cylindrical body supporting device of the present invention in order to support a rotary screen cylinder of a rotary screen apparatus in a screen printing unit.
Figure 2:
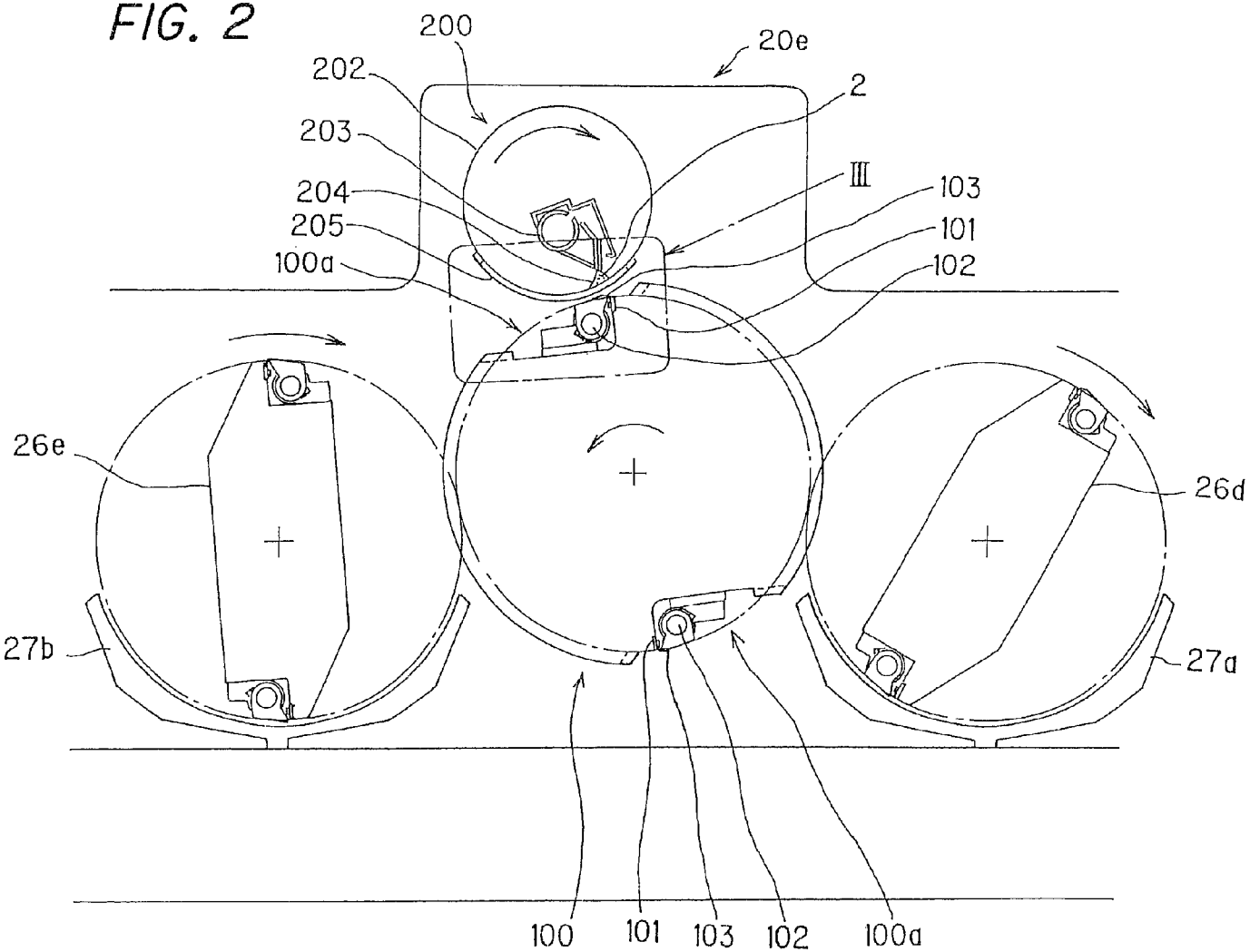
FIG. 2 shows an enlarged view extracting a portion indicated with an arrow II in FIG. 1.
Figure 3:
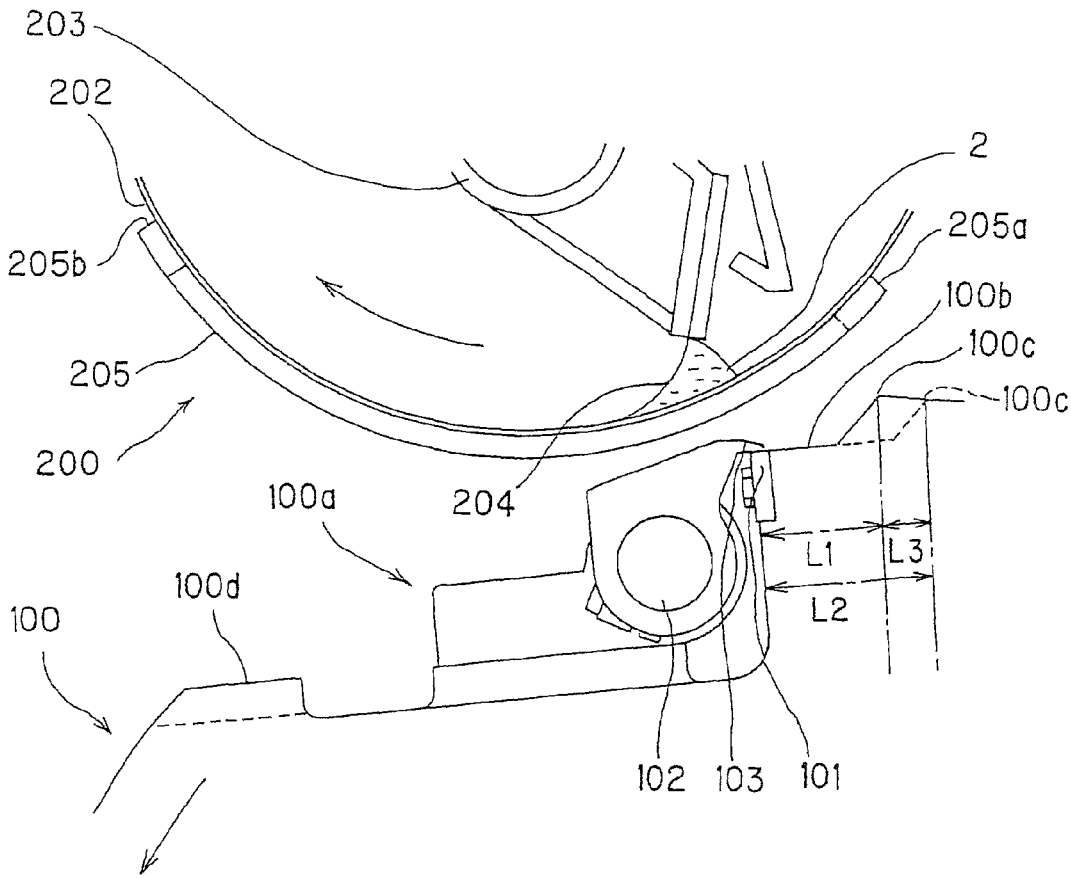
FIG. 3 shows an enlarged view extracting a portion indicated with an arrow III in FIG. 2.
Figure 4:
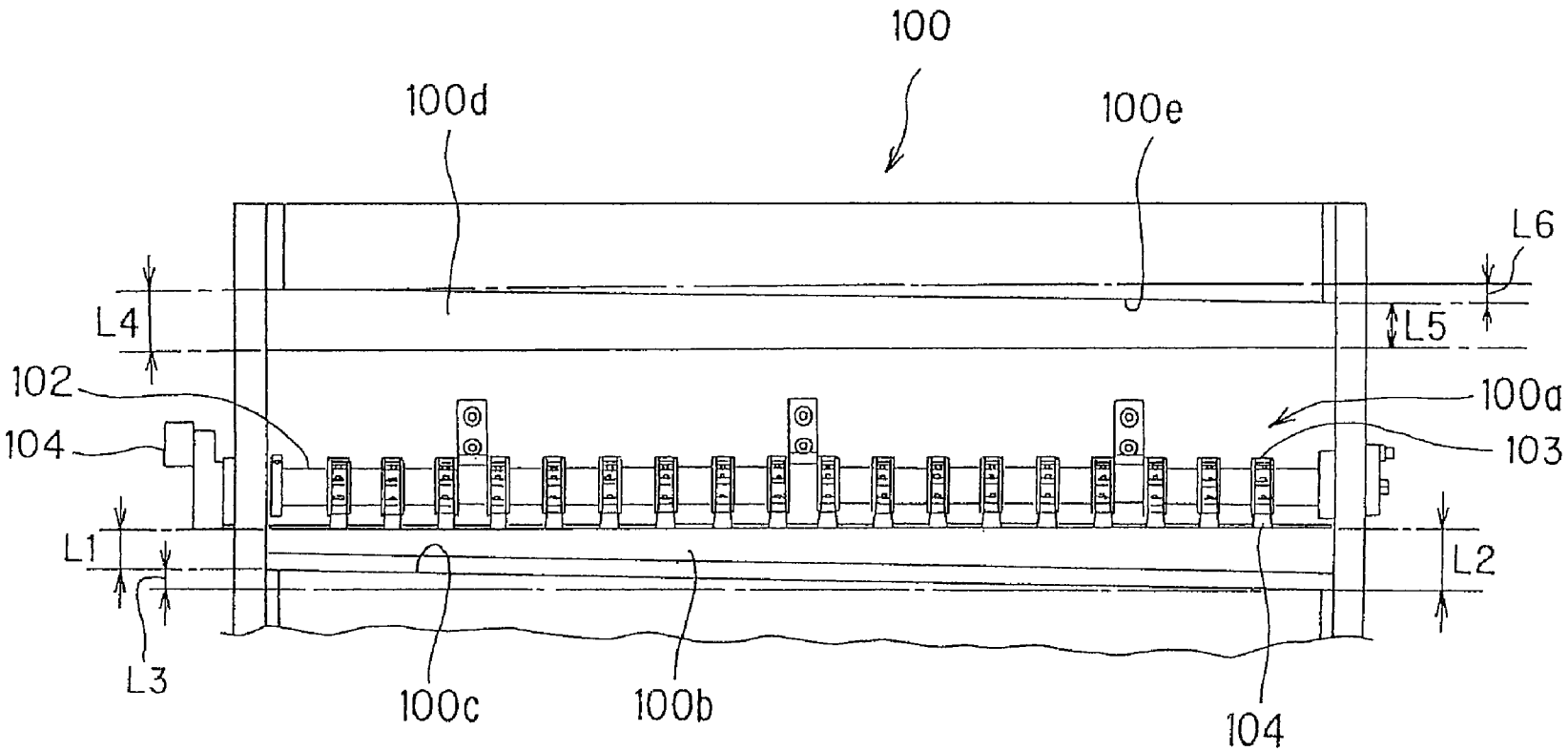
FIG. 4 shows a plan view of an impression cylinder shown in FIG. 2.
Figure 5:
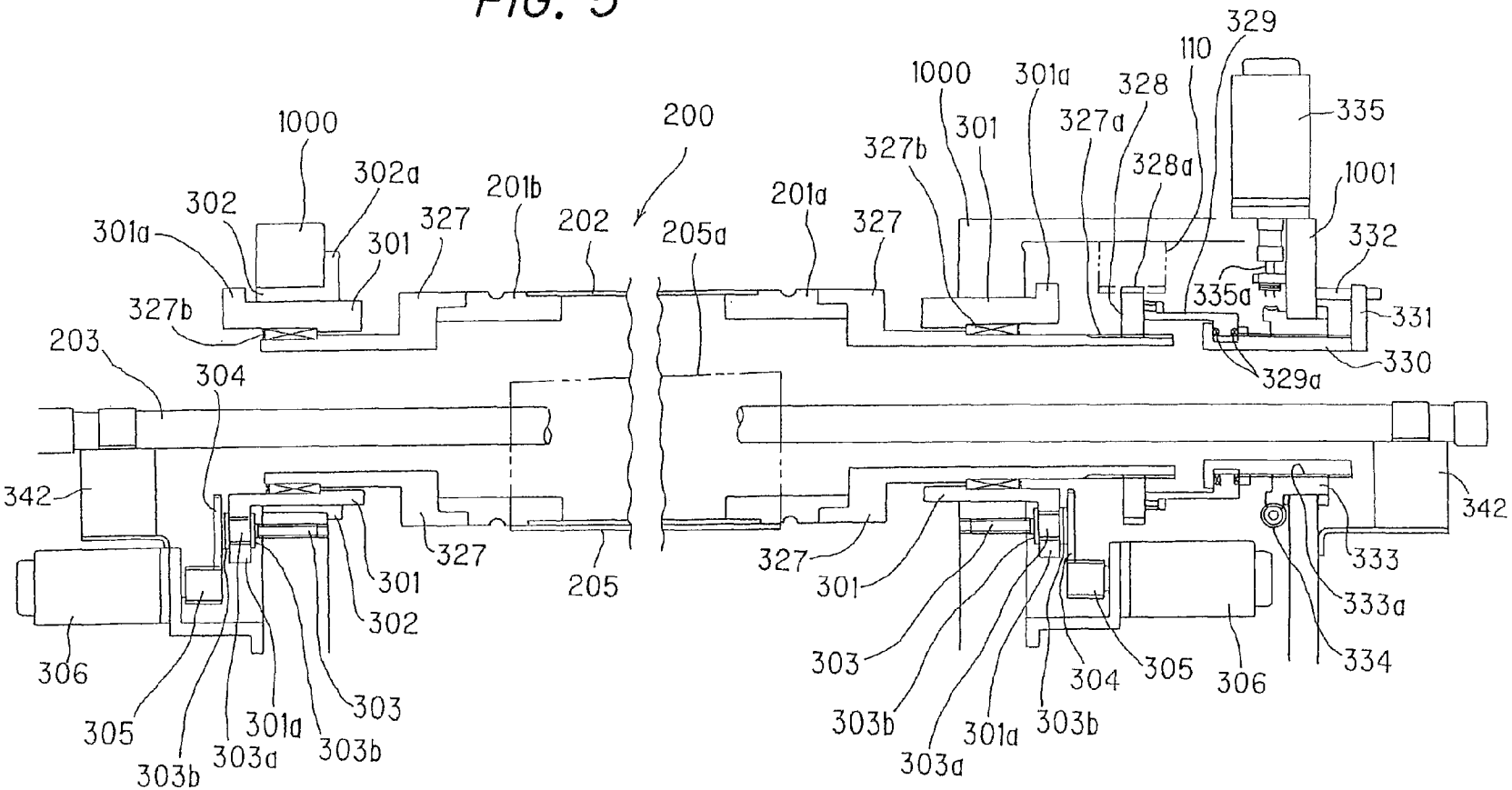
FIG. 5 shows a schematic structural drawing in terms of an axial direction of a supporting device for supporting a rotary screen cylinder of FIG. 2.
Figure 6:
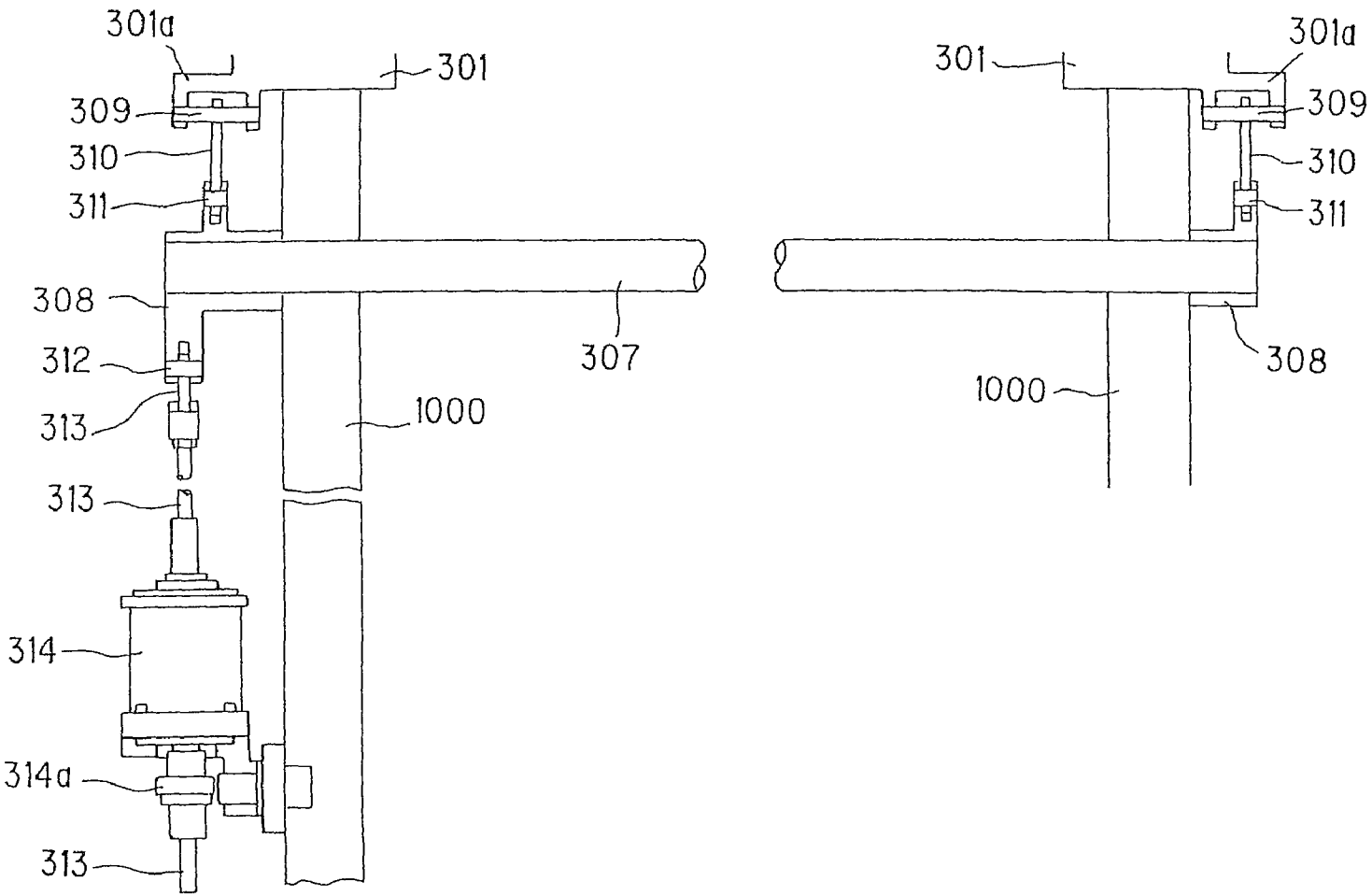
FIG. 6 shows a schematic structural drawing of other substantial parts of the supporting device shown in FIG. 5.
Figure 7:
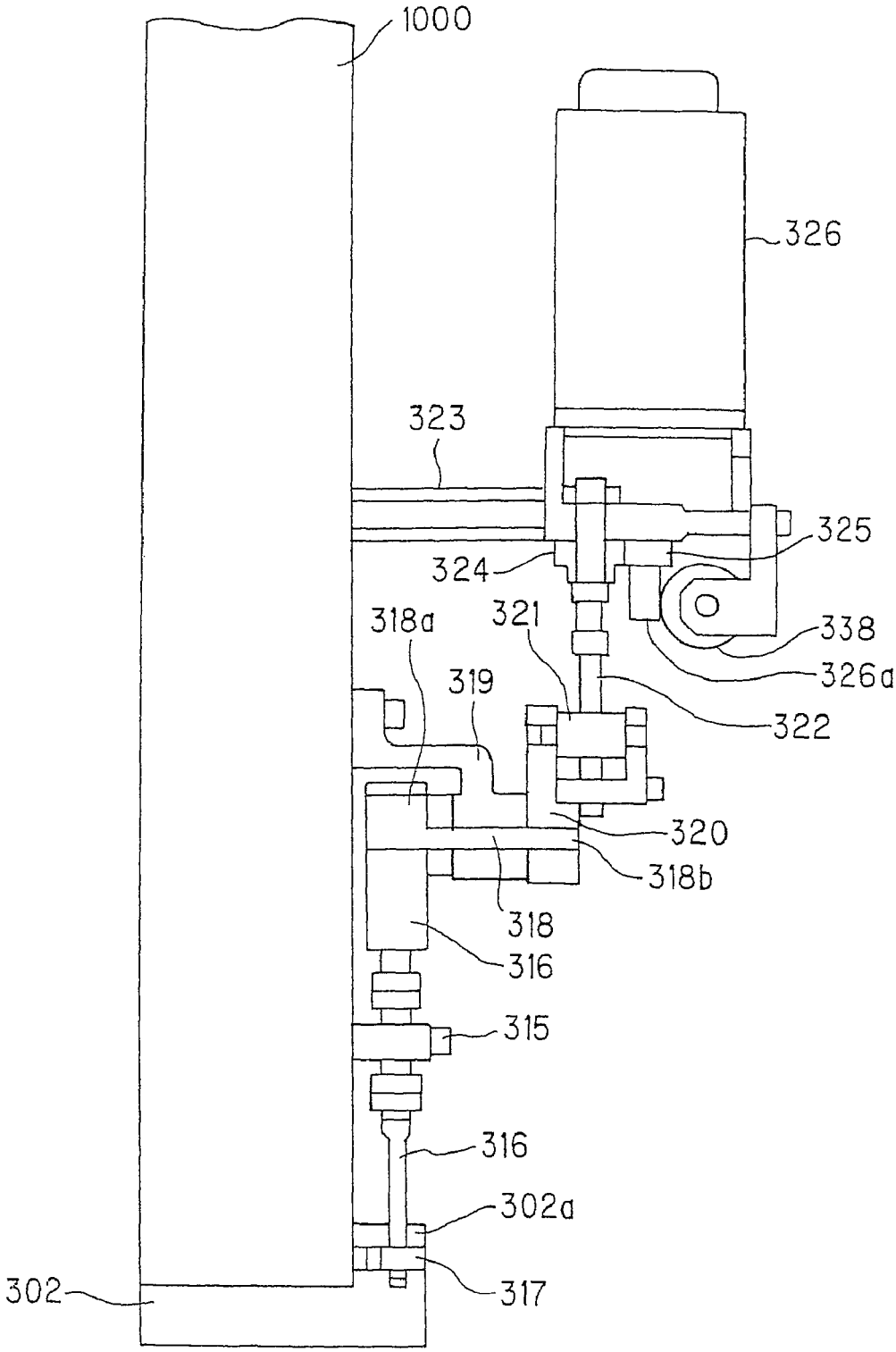
FIG. 7 shows a schematic structural drawing in terms of another axial direction of a substantial part of the supporting device shown in FIG. 5.
Figure 8:
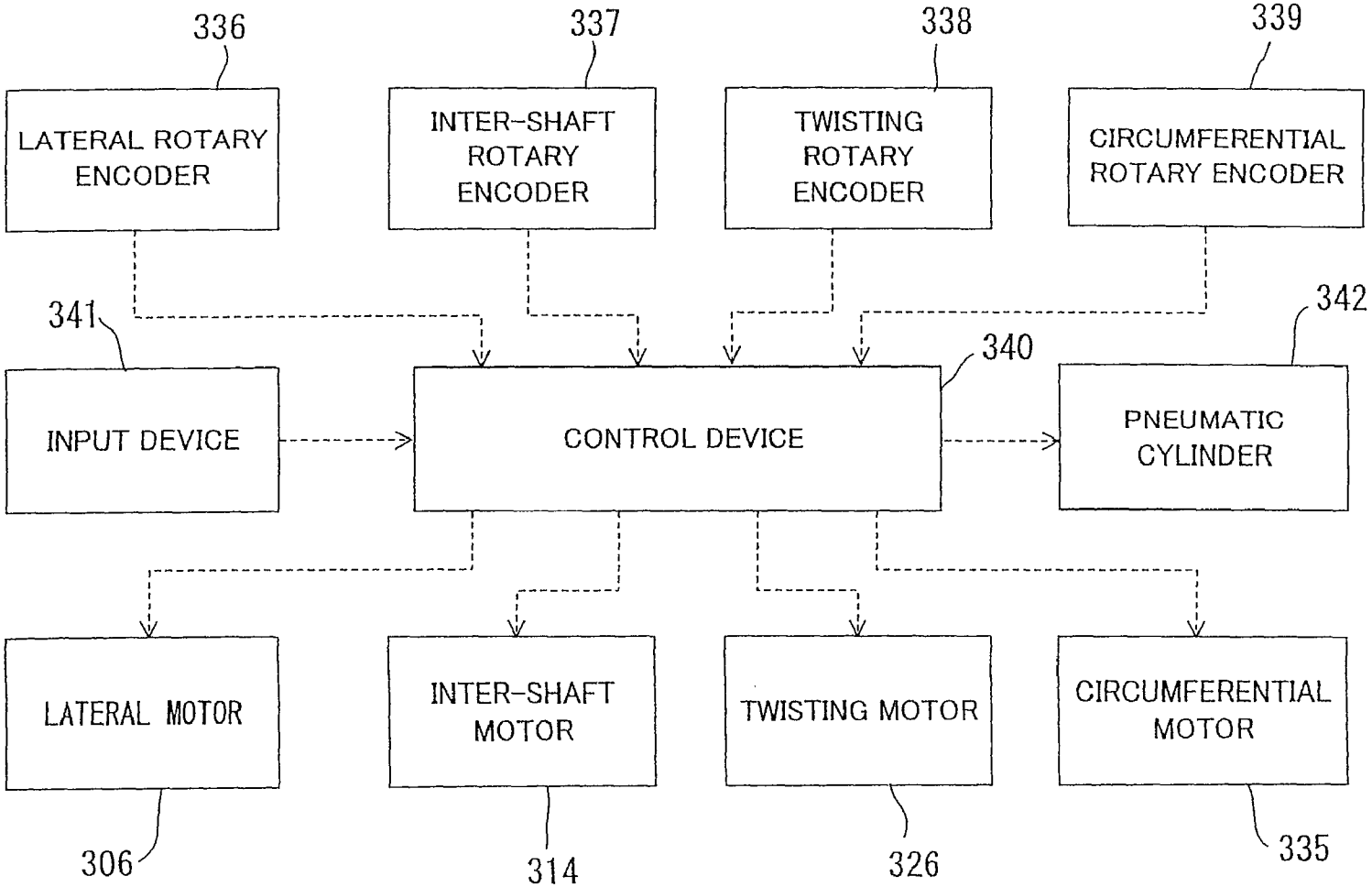
FIG. 8 shows a block diagram of a control system for the supporting device shown in FIG. 5.

An embodiment of a printing press applying a cylindrical body supporting device of the present invention in order to support a rotary screen cylinder of a rotary screen apparatus in a screen printing unit will be described with reference to FIG. 1 to FIG. 10. FIG. 1 is an overall schematic structural drawing of the printing press, FIG. 2 is an enlarged view extracting a portion indicated with an arrow II in FIG. 1, FIG. 3 is an enlarged view extracting a portion indicated with an arrow III in FIG. 2, FIG. 4 is a plan view of an impression cylinder shown in FIG. 2, FIG. 5 is a schematic structural drawing in terms of an axial direction of a supporting device for supporting a rotary screen cylinder of FIG. 2, FIG. 6 is a schematic structural drawing of other substantial parts of the supporting device shown in FIG. 5, FIG. 7 is a schematic structural drawing in terms of another axial direction of a substantial part of the supporting device shown in FIG. 5, and FIG. 8 is a block diagram of a control system for the supporting device shown in FIG. 5.

As shown in FIG. 1, a feeder 10 includes a feeder table 11. The feeder 10 also includes a feeder board 12 for sending flat paper sheets 1, which are sheets on the feeder table 11, one-by-one to a printing unit 20. At a front end of the feeder board 12, a swing arm shaft pregripper 13 is disposed to pass the flat paper sheet 1 to an impression cylinder 21*a* of a first offset printing unit 20*a* of the printing unit 20.

A blanket cylinder 22*a* is connected to the impression cylinder 21*a* of the first offset printing unit 20*a* of the printing unit 20 on a downstream side of the swing arm shaft pregripper 13 in a rotational direction. A plate cylinder 23*a* is connected to the blanket cylinder 22*a* on an upstream side of the impression cylinder 21*a* in a rotational direction. An ink supply device 24*a* is provided in a position on the plate cylinder 23*a* on an upstream side of the blanket cylinder 22*a* in a rotational direction. A dampening unit 25*a* is in a position on the plate cylinder 23*a* on an upstream side of the ink supply device 24*a* of in a rotational direction.

An impression cylinder 21*b* of a second offset printing unit 20*b* is connected through a transfer cylinder 26*a* to the impression cylinder 21*a* of the first offset printing unit 20*a* on a downstream side of the blanket cylinder 22*a* in a rotational direction. This second offset printing unit 20*b* includes a blanket cylinder 22*b*, a plate cylinder 23*b*, an ink supply device 24*b*, a dampening unit 25*b*, and the like which are arranged as similar to the first offset printing unit 20*a*.

Meanwhile, an impression cylinder 21*c* of a third offset printing unit 20*c* is connected through a transfer cylinder 26*b* to the impression cylinder 21*b* of the second offset printing unit 20*b* on a downstream side of the blanket cylinder 22*b* in a rotational direction. This third offset printing unit 20*c* also includes a blanket cylinder 22*c*, a plate cylinder 23*c*, an ink supply device 24*c*, a dampening unit 25*c*, and the like which are arranged as similar to the first and second offset printing units 20*a* and 20*b*.

Moreover, an impression cylinder 21*d* of a fourth offset printing unit 20*d* is connected through a transfer cylinder 26*c* to the impression cylinder 21*c* of the third offset printing unit 20*c* on a downstream side of the blanket cylinder 22*c* in a rotational direction. This fourth offset printing unit 20*d* also includes a blanket cylinder 22*d*, a plate cylinder 23*d*, an ink supply device 24*d*, a dampening unit 25*d*, and the like which are arranged as similar to the first to third offset printing units 20*a* to 20*c*.

As shown in FIGS. 1 and 2, an impression cylinder 100 of a screen printing unit 20*e* serving as a liquid supply apparatus is connected through a transfer cylinder 26*d*, which is formed of a skeleton cylinder (a solid cylinder) including a guiding device 27*a* for guiding transport of the flat paper sheet 1 by ejecting air as disclosed in Japanese Unexamined Patent Publication No. 2004-099314, for example, to the impression cylinder 21*d* of the fourth offset printing unit 20*d* on a downstream side of the blanket cylinder 22*d* in a rotational direction. The impression cylinder 100 has a structure to be described below.

As shown in FIGS. 2 to 4, gaps 100*a* extending along a direction of a shaft center of the impression cylinder 100 are formed in multiple positions (two positions in this embodiment) on an outer peripheral surface of the impression cylinder 100 at an even interval along a circumferential direction of the impression cylinder 100. A step portion 100*b* positioned closer to the shaft center of the impression cylinder 100 than the outer peripheral surface of the impression cylinder 100 is formed on the gap 100*a* of the impression cylinder 100 on the upstream side in a rotational direction (one side in the circumferential direction which is on a right side in FIG. 3 and on a lower side in FIG. 4) along the direction of the shaft center of the impression cylinder 100. Multiple gripper pads 101 are provided at predetermined intervals on the step portion 100*b* of the impression cylinder 100 along the direction of the shaft center of the impression cylinder 100.

A gripper shaft 102 is arranged inside the gap 100*a* of the impression cylinder 100 so that it takes a longitudinal direction along the direction of the shaft center of the impression cylinder 100. The gripper shaft 102 is rotatably supported relative to the impression cylinder 100. Multiple grippers 103 are provided at a given pitch along an axial direction of the gripper shaft 102 with their tip ends located on the gripper pads 101.

That is, the impression cylinder 100 is configured to set identical distances between shaft centers and the gripper pads 101 in terms of the impression cylinders 21*a* to 21*d*, the transfer cylinders 26*a* to 26*d*, and moreover, a transfer cylinder 26*e*, a transport cylinder 28, and a delivery cylinder 31 to be described later. Further, the impression cylinder 100 is also configured to set a longer distance between each shaft center and each outer peripheral surface. In this way, the impression cylinder 100 is able to pass the flat paper sheet 1 to and from the transfer cylinders 26*d* and 26*e* without causing the gripper pads 101 and the grippers 103 to project from the outer peripheral surface.

A boundary 100*c* between the step portion 100*b* of the gap 100*a* and the outer peripheral surface of the impression cylinder 100 is inclined relative to the direction of the shaft center of the impression cylinder 100 so that a length L1 of the step portion 100*b* on one side in the direction of the shaft center (which is a front side of the drawing in terms of FIG. 3 or a left side in terms of FIG. 4) of the impression cylinder 100 becomes smaller than a length L2 of the step portion 100*b* on the other side in the direction of the shaft center (which is a back side of the drawing in terms of FIG. 3 or a right side in terms of FIG. 4). In other words, a length of the outer peripheral surface of the impression cylinder 100 close to the step portion 100*b* is set such that the one end in the direction of the shaft center of the boundary 100*c* on the impression cylinder 100 is positioned closer to the gripper shaft 102 by a length L3 than the other end thereof.

In the meantime, a step portion 100*d* positioned closer to the shaft center of the impression cylinder 100 than the outer peripheral surface of the impression cylinder 100 is formed at the gap 100*a* of the impression cylinder 100 on a downstream side in terms of the rotational direction (on the other side in the circumferential direction, which is a left side in FIG. 3 or an upper side in FIG. 4) of the impression cylinder 100 along the direction of the shaft center of the impression cylinder 100. A boundary 100*e* between the step portion 100*d* of the gap 100*a* and the outer peripheral surface of the impression cylinder 100 is inclined relative to the direction of the shaft center of the impression cylinder 100 so that a length L4 of the step portion 100*d* on the one side in the direction of the shaft center (which is the front side of the drawing in terms of FIG. 3 or the left side in terms of FIG. 4) of the impression cylinder 100 becomes greater than a length L5 of the step portion 100*d* on the other side in the direction of the shaft center (which is the back side of the drawing in terms of FIG. 3 or the right side in terms of FIG. 4). In other words, a length of the outer peripheral surface of the impression cylinder 100 close to the step portion 100*d* is set such that the other end in the direction of the shaft center of the boundary 100*e* on the impression cylinder 100 is positioned closer to the gripper shaft 102 by a length L6 than the one end thereof.

Here, reference numeral 104 in FIG. 4 denotes a cam follower for rotationally moving the gripper shaft 102. In this embodiment, the gripper pads 101, the gripper shaft 102, the grippers 103, and the like collectively constitute seat holding means.

Moreover, as shown in FIGS. 1 to 3, a rotary screen cylinder of a rotary screen apparatus 200 is connected to the impression cylinder 100 of the screen printing unit 20*e* on a downstream side in terms of the rotational direction of the transfer cylinder 26*d*. The rotary screen apparatus 200 has a structure to be described below.

As shown in FIGS. 2, 3, and 5, inside a screen 202 of a rotary screen cylinder which is a thin cylindrical plate material having small holes etched in accordance with an image and is supported at both end portions by hollow cylindrical flanges 201*a* and 201*b*, there are a squeegee shaft 203 supported at both end sides as movable in a diametrical direction toward a frame 1000 through an pneumatic cylinder 342 and configured to supply special ink 2, and a squeegee 204 for supplying the special ink 2 that is supplied by the squeegee shaft 203 from the small holes on the screen 202 toward the impression cylinder 100.

The flanges 201*a* and 201*b* are provided with a guard 205 which is a guide member configured to be positioned between the gap 100*a* of the impression cylinder 100 and the screen 202 when opposed to the gap 100*a* and to movably support the squeegee 204 through the screen 202. The guard 205 is formed into an arc shape including an inner peripheral surface having substantially the same curvature as curvature of an outer peripheral surface of the screen 202.

Moreover, the guard 205 is designed to enter the gap 100*a* of the impression cylinder 100 without contacting the outer peripheral surface of the impression cylinder 100, the grippers 103, and the like while the impression cylinder 100 and the screen 202 are rotating being contacted with each other, and to give a clearance having a length smaller than the length L3 between an end portion 205*a* on an upstream side in the rotational direction and an end portion on the upstream side in terms of the rotational direction (the boundary 100*c*) of the gap 100*a* of the impression cylinder 100 when these ends oppose each other. Meanwhile, the guard 205 is also designed to give a clearance having a length greater than the length L6 between an end portion 205*b* on a downstream side in the rotational direction and an end portion on the downstream side in a rotational direction (the boundary 100*e*) of the gap 100*a* of the impression cylinder 100 when these ends oppose each other. To achieve the foregoing configurations, a position of the guard 205 relative to the screen 202, as well as a length in the circumferential direction and shapes of the end portions 205*a* and 205*b* (such as angles of inclination relative to a direction of a shaft center of the screen 202), and the like are set appropriately corresponding to the shapes of the gap 100*a*, the boundaries 100*c* and 100*e*, and other factors of the impression cylinder 100.

Moreover, as shown in FIG. 5, the rotary screen cylinder of the rotary screen apparatus 200 is supported, in a detachable, drivable and rotatable manner, by a cylindrical body supporting device according to the present invention, which has the structure to be described below.

As shown in FIG. 5, first eccentric bearings 301 constituting a pair of first bearing members, which have an eccentric inner peripheral shaft center deviated from a shaft center of an outer periphery, are respectively provided on a pair of frames 1000 coaxially so as to be capable of sliding and rotating in a circumferential direction as well as of sliding and traveling in a direction of a shaft center. In a space between one of the frames 1000 (on the left side in FIG. 5) and the first eccentric bearing 301, a second eccentric bearing 302 constituting a second bearing member, which has an eccentric inner peripheral shaft center deviated from a shaft center of an outer periphery, is provided so as to be capable of sliding and rotating in a circumferential direction. That is, one of the first eccentric bearings 301 (on the left side in FIG. 5) is eccentrically supported on the frame 1000 through the second eccentric bearing 302 so as to be capable of sliding and rotating in the circumferential direction as well as of sliding and traveling in the direction of the shaft center.

Adjusting screws 303 are screwed on the frame 1000 so as to locate axial directions thereof along the directions of the shaft centers of the eccentric bearings 301 and 302, respectively. Heads 303*a* of the adjusting screws 303 are loosely fitted to long holes of flanges 301*a* which are formed on the first eccentric bearings 301. A tip end and a base end of the head 303*a* of the adjusting screw 303 are respectively provided with a pair of flanges 303*b* for sandwiching the flange 301*a* of the first eccentric bearing 301 in the axial direction of the eccentric bearing 301.

Spur gears 304 are respectively fitted to the flanges 303*b* on the tip end side of the heads of the adjusting screws 303 coaxially with the adjusting screws 303. Spur-type spline gears 305 are respectively meshed with the spur gears 304. The spline gears 305 are respectively connected to lateral motors 306 which are fixed to and supported by the frame 1000.

That is, when the lateral motors 306 are activated, the adjusting screws 303 are rotated through the spline gears 305 and the spur gears 304 and travel along the directions of the shaft centers of the eccentric bearings 301 and 302 relative to the frame 1000. In this way, it is possible to allow the first eccentric bearings 301 to slide and travel along the direction of the shaft center.

The adjusting screws 303, the spur gears 304, the spline gears 305, the lateral motors 306, and the like collectively constitute first driving means in this embodiment.

Meanwhile, as shown in FIG. 6, in the vicinities of the first eccentric bearings 301, a shaft 307 that is aligned with an axial direction along the direction of the shaft centers of the eccentric bearings 301 is supported in a rotationally movable manner so as to connect a space between the pair of frames 1000. Levers 308 are respectively fitted to both shaft ends of the shaft 307.

Moreover, as shown in FIG. 6, the flanges 301*a* of the first eccentric bearings 301 respectively support both ends of pins 309, of which axial directions are aligned with the directions of the shaft centers of the eccentric bearings 301. One end of a rod 310 is connected to each of the pins 309 in a rotationally movable manner. The other end of the rod 310 is connected, in a rotationally movable manner, to each of the levers 308 through a pin 311 of which an axial direction is aligned with the direction of the shaft center of the eccentric bearing 301.

As shown in FIG. 6, one end of a driving rod 313 is connected, in a rotationally movable manner, to one of the levers 308 (on the left side in FIG. 6) through a pin 312, of which an axial direction is aligned with the direction of the shaft center of the eccentric bearing 301. Screw threads are formed on the other end of the driving rod 313, which is screwed into a driving nut 314*a* of an inter-shaft motor 314 supported by the frames 1000.

In short, when the inter-shaft motor 314 is activated to rotate the driving nut 314*a*, the driving rod 313 travels in the axial direction and one of the levers 308 (on the left side in FIG. 6) swings through the pin 312. Along with the swing of the lever 308, the other lever 308 (on the right side in FIG. 6) also swings synchronously. By the swings of these levers 308, it is possible to rotationally move the pair of the first eccentric bearings 301 through the pins 311, the rod 310, and the pins 309.

The shaft 307, the levers 308, the pins 309, the rods 310, the pins 311, the pin 312, the driving rod 313, the inter-shaft motor 314, and the like collectively constitute second driving means in this embodiment.

On the other hand, as shown in FIG. 7, one end of a lever 316 is connected, in a rotationally movable manner, to a flange 302*a* of the second eccentric bearing 302 through a pin 317. A central part of the lever 316 is swingably supported by the frame 1000 through a shaft 315, of which an axial direction is aligned with the direction of the shaft center of the eccentric bearing 302.

A large diameter portion 318*a* of a transmission shaft 318, of which an axial direction is aligned with the direction of the shaft center of the eccentric bearing 302, is fitted, in a rotationally movable manner, to the other end of the lever 316. Of this transmission shaft 318, a small diameter portion 318*b* formed eccentrically relative to a shaft center of the large diameter portion 318*a* is supported, in a rotationally movable manner, by the frame 1000 through a movably supporting member 319. One end of a lever 320 is fitted and fixed to the small diameter portion 318*b* of the transmission shaft 318.

A top 321 is pivotally attached to the other end of the lever 320 as rotationally movable around the same axis as the transmission shaft 318. One end of a rod 322 having screw threads formed thereon is screwed into the top 321 while aligning an axial direction thereof with an orthogonal direction to the axial direction of the transmission shaft 318. The other end of this rod 322 is rotatably supported by the frame 1000 through a movably supporting member 323. A gear 324 is coaxially fitted to the other end of the rod 322.

A gear 325 is meshed with the gear 324. This gear 325 is disposed coaxially with a driving shaft 326*a* of a twisting motor 326 which is fixed to and supported by the frame 1000.

That is, the rod 322 is rotated by activating the twisting motor 326 through the gears 325 and 324 and the position of the top 321 in terms of the axial direction of the rod 322 is changed, thereby rotationally moving the transmission shaft 318 through the lever 320. The second eccentric bearing 302 can be rotationally moved by allowing the lever 316 to swing as a consequence of the rotational movement of the transmission shaft 318.

The shaft 315, the lever 316, the pin 317, the transmission shaft 318, the lever 320, the top 321, the rod 322, the gear 324, the gear 325, the twisting motor 326, and the like collectively constitute third driving means in this embodiment.

Moreover, as shown in FIG. 5, cylindrical holders 327 constituting a pair of supporting members, which are configured to be fitted coaxially with and detachably to outer peripheries of the flanges 201*a* and 201*b* of the rotary screen apparatus 200, are respectively fitted to inner peripheral surfaces of the first eccentric bearings 301 respectively with bearings 327*b* coaxially with shaft centers of the inner peripheries of the eccentric bearings 301. Each of the holders 327 is able to rotate in a circumferential direction relative to the first eccentric bearing 301. Moreover, the holder 327 is supported so as not to be able to travel in the direction of the shaft center relative to the first eccentric bearing 301, or in other words, is able to travel in the direction of the shaft center integrally with the first eccentric bearing 301.

Further, as shown in FIG. 5, a base end of the other holder 327 (on the right side in FIG. 5) extends to the outside of the frame 1000. A spline 327*a* is formed on an outer peripheral surface on the base end of the other holder 327. An inner peripheral surface of a boss 328 constituting a power transmission member to be meshed with the spline 327*a* is fitted slidably and movably to the spline 327*a* of the other holder 327. Helical teeth 328*a* to be meshed with a helical gear 110 to be provided coaxially with the impression cylinder 100 are formed on an outer peripheral surface of this boss 328.

One end of a cylindrical carrier member 329 is fitted to an end surface of the boss 328 coaxially with the boss 328. The other end of the carrier member 329 is connected to one end of a cylindrical screw shaft 330 including screw threads, which are formed on an outer peripheral surface thereof, coaxially through a thrust bearing 329*a*. One end of a plate 331 is fitted to the other end of the screw shaft 330 so as to align an axial direction thereof along a diametrical direction of the screw shaft 330. A pin 332 which is provided in a projecting manner on a subframe 1001 so as to align an axial direction along the axial direction of the screw shaft 330 is slidably and movably inserted into the other end of the plate 331.

Meanwhile, an outer peripheral surface of the screw shaft 330 is screwed coaxially into an inner peripheral surface of a cylindrical worm wheel 333 having a screw portion 333*a* formed thereon. This worm wheel is rotatably supported by the subframe 1001. A worm 334 is meshed with the worm wheel 333. This worm 334 is connected coaxially to a driving shaft 335*a* of a circumferential motor 335 which is fixed to and supported by the subframe 1001.

That is, as the boss 328 is rotated along with rotation of the helical gear 110 of the impression cylinder, it is possible to drivably rotate the other holder 327 (on the right side in FIG. 5). At the same time, by activating the circumferential motor 335, the worm wheel 333 is rotated through the worm 334. Along with rotation of the worm wheel 333, the screw shaft 330 travels along the pin 332 through the plate 331, and allows the boss 328 to travel in the direction of the shaft center through the carrier member 329. As the boss 328 travels in the direction of the shaft center, it is possible to rotationally move the impression cylinder 100 in the circumferential direction through the helical gear 110. In this way, it is possible to adjust a phase (a circumferential register) relative to the screen 202 of the rotary screen apparatus 200.

The carrier member 329, the screw shaft 330, the plate 331, the pin 332, the worm wheel 333, the worm 334, the circumferential motor 335, and the like collectively constitute fourth driving means in this embodiment.

Meanwhile, as shown in FIG. 8, the respective motors 306, 314, 326, and 335 as well as the pneumatic cylinder 342 described above are connected electrically to an output unit of a control device 340 constituting controlling means. Moreover, rotary encoders 336 to 339 constituting detecting means for detecting respective amounts of rotation of the motors 306, 314, 326, and 335 are electrically connected to an input unit of the control device 340. An input device 341 is electrically connected to the input unit of the control device 340.

That is, upon an input instruction from the input device 341, the control device 340 is rendered capable of controlling the pneumatic cylinder 342, and of performing feedback control of the amounts of rotation of the motors 306, 314, 326, and 335 based on information from the rotary encoders 336 to 339 (to be described later in detail).

As shown in FIG. 1, the transfer cylinder 26*e* formed of a skeleton cylinder (a solid cylinder) including a guiding device 27*b* for guiding transport of the flat paper sheet 1 by ejecting air as disclosed in Japanese Unexamined Patent Publication No. 2004-099314, for example, is connected to the impression cylinder 100 of the screen printing unit 20*e* on the downstream side in a rotational direction of the rotary screen apparatus 200. A transport cylinder 28 of a drying unit 20*f* is connected to the transfer cylinder 26*e* on the downstream side in a rotational direction of the impression cylinder 100. A drying lamp 29 for irradiating ultraviolet (UV) rays is provided on the transport cylinder 28 on the downstream side in a rotational direction of the transfer layer 26*e*.

A delivery cylinder 31 of a delivery unit 30 is connected to the transfer cylinder 28 of the drying unit 20*f* on a downstream side in a rotational direction of the drying lamp 29. The delivery cylinder 31 includes a sprocket 32 which is rotatable coaxially and integrally with the delivery cylinder 31. Moreover, the delivery unit 30 includes a delivery table 35. A sprocket 33 is placed above the delivery table 35. A delivery chain 34 including multiple unillustrated delivery grippers arranged at a given pitch is put on the sprockets 32 and 33.

Operations of the printing press having the above-described configuration according to this embodiment will now be described below.

Each flat paper sheet 1 individually sent out from the feeder table 11 of the feeder 10 onto the feeder board 12 is passed to the impression cylinder 21*a* of the first offset printing unit 20*a* of the printing unit 20 by use of the swing arm shaft pregripper 13. In the meantime, ink and dampening water are respectively supplied from the ink supply device 24*a* and the dampening unit 25*a* of the first offset printing unit 20*a* to the plate cylinder 23*a*, and then from the plate cylinder 23*a* to the blanket cylinder 22*a*. Thereafter, the ink is transferred from the blanket cylinder 22*a* to the flat paper sheet 1, and the flat paper sheet 1 is thereby subjected to printing in a first color. Then, the flat paper sheet 1 is passed to the impression cylinder 21*b* of the second offset printing unit 20*b* through the transfer cylinder 26*a*, and is subjected to printing in a second color by the second offset printing unit 20*b* in a similar manner to the first offset printing unit 20*a*. Thereafter, the flat sheet paper 1 is subjected to printing in third and fourth colors by the third and fourth offset printing units 20*c* and 20*d* similarly.

Then, the flat paper sheet 1 is subjected to a gripping change to the gripper pads 101 and the grippers 103 of the impression cylinder 100 of the screen printing unit 20*e* through the transfer cylinder 26*d*. In the rotary screen apparatus 200 of the screen printing unit 20*e*, the screen 202 is rotated along with rotation of the impression cylinder 100 and the special ink 2 inside the squeegee shaft 203 is pushed out of the small holes on the screen 202 by the squeegee 204 and is thereby supplied to perform thick printing of the special ink 2 corresponding to the small holes of the screen 202. Thereafter, the flat paper sheet 1 is passed from the impression cylinder 100 to the transport cylinder 28 of the drying unit 20*f* through the transfer cylinder 26*e*, and the printed special ink 2 is dried by UV irradiation from the drying lamp 29. Then, the flat paper sheet 1 is passed to the delivery cylinder 31 of the delivery unit 30, then transported by the delivery grippers in accordance with a traveling motion of the delivery chain 34, and then delivered onto the delivery table 35.

Thus, in the course of printing the flat paper sheet as described above, the screen 202 and the squeegee 204 of the rotary screen apparatus 200 do not fall into the gap 100*a* of the impression cylinder 100 because in the screen printing unit 20*a* mounted is the guard 205 which movably supports the squeegee 204 through the screen 202 and which is located between the gap 100*a* and the screen 202 when the rotary screen apparatus 200 opposes to the gap 100*a* of the impression cylinder 100.

Moreover, in terms of the impression cylinder 100, the boundaries 100*c* and 100*e* between the step portions 100*b* and 100*d* of the gap 101*a* and the outer peripheral surface are inclined relative to the direction of the shaft center as described previously. Further, in terms of the rotary screen apparatus 200, the length in the circumferential direction of the guard 205, the shapes of the end portions 205*a* and 205*b* (such as the angles of inclination relative to the direction of the shaft center of the screen 202), and the like are set in accordance with the shapes of the gap 101*a* and the boundaries 100*c* and 100*e* of the impression cylinder 100. Accordingly, it is possible to movably support the squeegee 204 oriented along the direction of the shaft center temporarily by use of both of the outer peripheral surface of the impression cylinder 100 and the guard 205 at the same time. In this way, it is possible to ensure prevention of even slight falling that is apt to occur when the squeegee 204 on the outer peripheral surface of the impression cylinder 100 moves onto the guard 205 or when the squeegee 204 on the guard 205 moves onto the outer peripheral surface of the impression cylinder 100.

For this reason, in the printing press according to this embodiment, it is possible by the simple structure to prevent clashes between the grippers 103 and the rotary screen apparatus 200 or falling of the screen 202 or the squeegee 204 into the gap 100*a* without causing any vibration of the impression cylinder 100 of the screen printing unit 20*e* even at the time of high-speed printing.

Therefore, in the printing press according to this embodiment, it is possible to print the special ink 2 from the small holes on the screen 202 of the rotary screen apparatus 200 onto the flat paper sheet 1 held on the impression cylinder 100 of the screen printing unit 20*e* favorably and at low costs even at the time of high-speed printing.

When the rotary screen cylinder of the rotary screen apparatus 200 in the screen printing unit 20*e* is replaced after completion of printing on the flat paper sheet 1 as described above, an instruction for detaching the rotary screen cylinder is input from the input device 341 to the control device 340. Then, the control device 340 extends the pneumatic cylinder 342 and thereby moves the squeegee shaft 203 to a retracting position so as to disengage the squeegee 204 of the rotary screen apparatus 200 from the screen 202. At the same time, the control device 340 causes the inter-shaft motor 314 to rotate in a predetermined amount based on a signal from the rotary encoder 337, thereby rotationally moving the first eccentric bearings 301 as described previously to separate the screen 202 sufficiently from the impression cylinder 100. Thereafter, the control device 340 causes the lateral motors 306 to rotate in predetermined amounts based on a signal from the rotary encoder 336 to respectively move the pair of the first eccentric bearings 301 in separating directions from each other along the direction of the shaft center, thereby respectively moving the pair of the holders 327 in separating directions from each other. Accordingly, the rotary screen cylinder is detached and released from the respective flanges 201*a* and 201*b* of the rotary screen apparatus 200.

Subsequently, the new rotary screen cylinder is placed between the pair of the holders 327, and an instruction for attaching the rotary screen cylinder is input from the input device 341 to the control device 340. Then, the control device 340 rotates the lateral motors 306 in predetermined amounts based on a signal from the rotary encoder 336 and thereby moves the pair of the first eccentric bearings 301 in approaching directions to each other along the direction of the shaft center as described previously. In this way, the control device 340 moves the pair of the holders 327 in the approaching directions to each other to support the rotary screen cylinder by fitting the rotary screen cylinder into the respective flanges 201*a* and 201*b* of the rotary screen apparatus 200. Thereafter, the inter-shaft motor 314 is rotated in a predetermined amount based on a signal from the rotary encoder 337 to rotationally move the first eccentric bearings 301 as described previously to cause the screen 202 to abut on the impression cylinder 100. At the same time, the control device 340 retracts the pneumatic cylinder 342 and thereby moves the squeegee shaft 203 to an active position so that the squeegee 204 abuts on the screen 202. In this way, it is possible to replace the rotary screen cylinder.

Meanwhile, when instructions on the thickness of the flat paper sheet 1 and printing pressure onto the flat paper sheet 1 are input from the input device 341 to the control device 340, the control device 340 moves the inter-shaft motor 314 in a predetermined amount based on a signal from the rotary encoder 337, and thereby rotationally moves the first eccentric bearings 301 as described previously. In this way, the control device 340 adjusts an inter-shaft distance between the impression cylinder 100 of the screen printing unit 20*e* and the rotary screen cylinder of the rotary screen apparatus 200.

Moreover, when the image is deviated in the lateral direction in terms of the flat paper sheet 1 as a result of printing on the flat paper sheet 1 as described above, an instruction on an amount of deviation in the lateral direction is input from the input device 341 to the control device 340. Then, the control device 340 rotates the lateral motors 306 in predetermined amounts based on a signal from the rotary encoder 336, and thereby synchronously moves the pair of the first eccentric bearings 301 in the same direction and in the same amount along the direction of the shaft center. Accordingly, the control device 340 moves the flanges 201*a* and 201*b* of the rotary screen apparatus 200 and the screen 202 in predetermined amounts in the lateral direction through the holders 327. In this way, the lateral register of the rotary screen cylinder of the rotary screen apparatus 200 is adjusted.

On the other hand, when the image is obliquely deviated in terms of the flat paper sheet 1, an instruction on an amount of such an oblique deviation is input from the input device 341 to the control device 340. Then, the control device 340 rotates the twisting motor 326 in a predetermined amount based on a signal from the rotary encoder 338 to rotationally move the second eccentric bearing 302 as described previously. Accordingly, the control device 340 changes the position of the shaft center in terms of one of the holders 327 through one of the first eccentric bearings 301, and thereby changes the amount of oblique deviation in the rotary screen cylinder of the rotary screen apparatus 200. In this way, the register in the twisting direction of the rotary screen cylinder of the rotary screen apparatus 200 is adjusted.

Meanwhile, when the image is deviated in the circumferential direction relative to the flat paper sheet 1, an instruction on an amount of such a circumferential deviation is input from the input device 341 to the control device 340. Then, the control device 340 rotates the circumferential motor 335 in a predetermined amount based on a signal from the rotary encoder 339 to move the boss 328 in a predetermined amount along the direction of the shaft center as described previously. Accordingly, the control device 340 rotationally moves the impression cylinder 100 in the circumferential direction through the helical gear 110. In this way, the phase relative to the rotary screen cylinder of the rotary screen apparatus 200, i.e. the circumferential register is adjusted.

Moreover, the length in the circumferential direction of the guard 205, the shapes of the end portions 205*a* and 205*b*, and the like are set so as to give the clearance between the end portion 205*a* of the guard 205 of the rotary screen apparatus 200 located on the upstream side in a rotational direction and the end portion (the boundary 100*c*) of the gap 100*a* of the impression cylinder 100 on the upstream side in a rotational direction having a smaller length than the length L3 when these end portions oppose to each other, and to give the clearance between the end portion 205*b* of the guard 205 of the rotary screen apparatus 200 located on the downstream side in terms of the rotational direction and the end portion (the boundary 100*e*) of the gap 100*a* of the impression cylinder 100 on the upstream side in a rotational direction having a smaller length than the length L6 when these end portions oppose to each other. Therefore, the guard 205 does not become an obstacle when performing register adjustments in the lateral and circumferential directions, and a twisting register adjustment, the rotary screen apparatus 200. Accordingly, it is possible to perform above-described register adjustments of the rotary screen apparatus 200 without any problems.

Therefore, in the printing press according to this embodiment, it is possible to adjust a delicate deviation in terms of the position (to perform register adjustment) of the rotary screen cylinder of the rotary screen apparatus 200 in the screen printing unit 20*e* easily.

Other Embodiments

Figure 9:
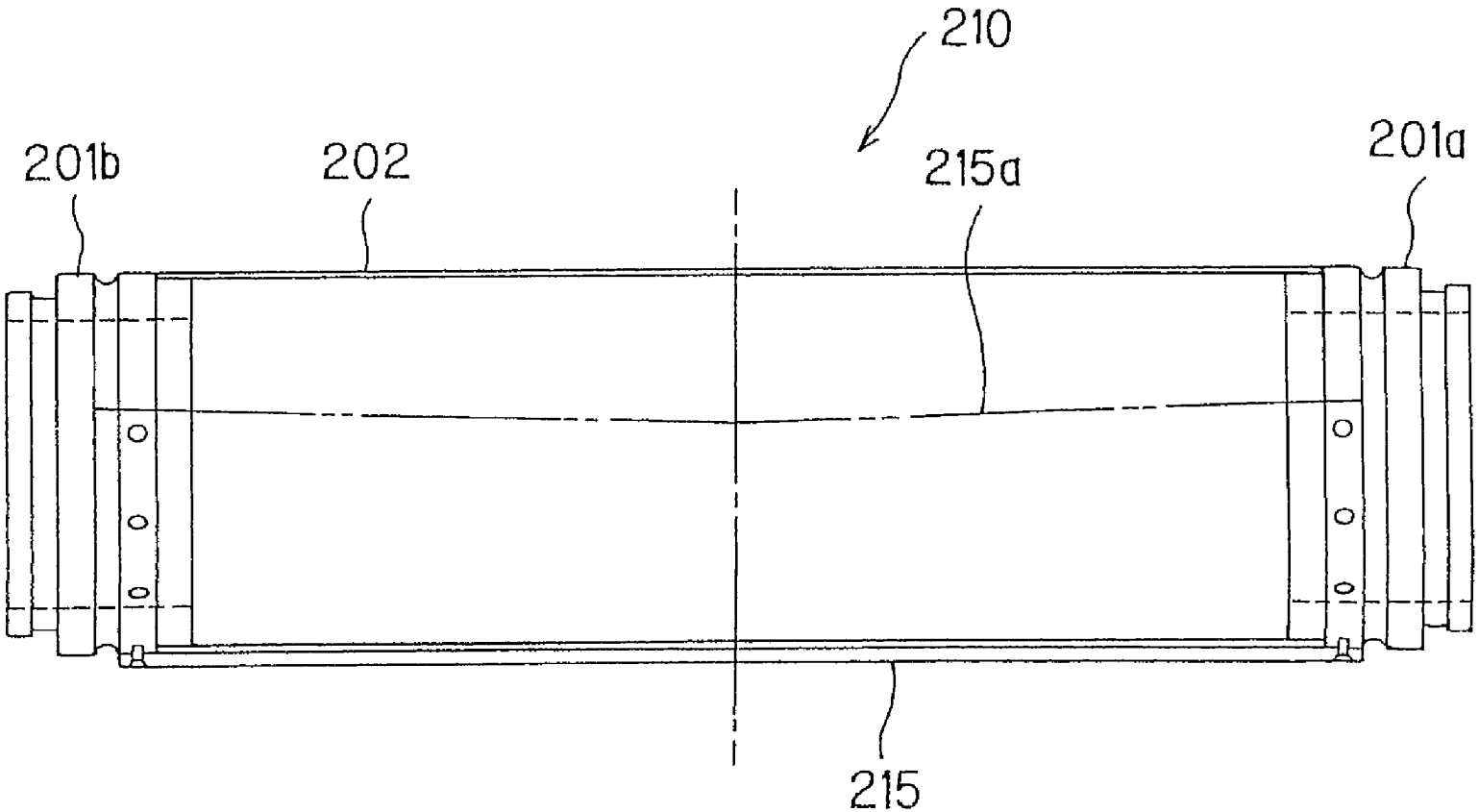
FIG. 9 shows a cross-sectional view in terms of an axial direction of a substantial part of a rotary screen cylinder of another embodiment.
Figure 10:
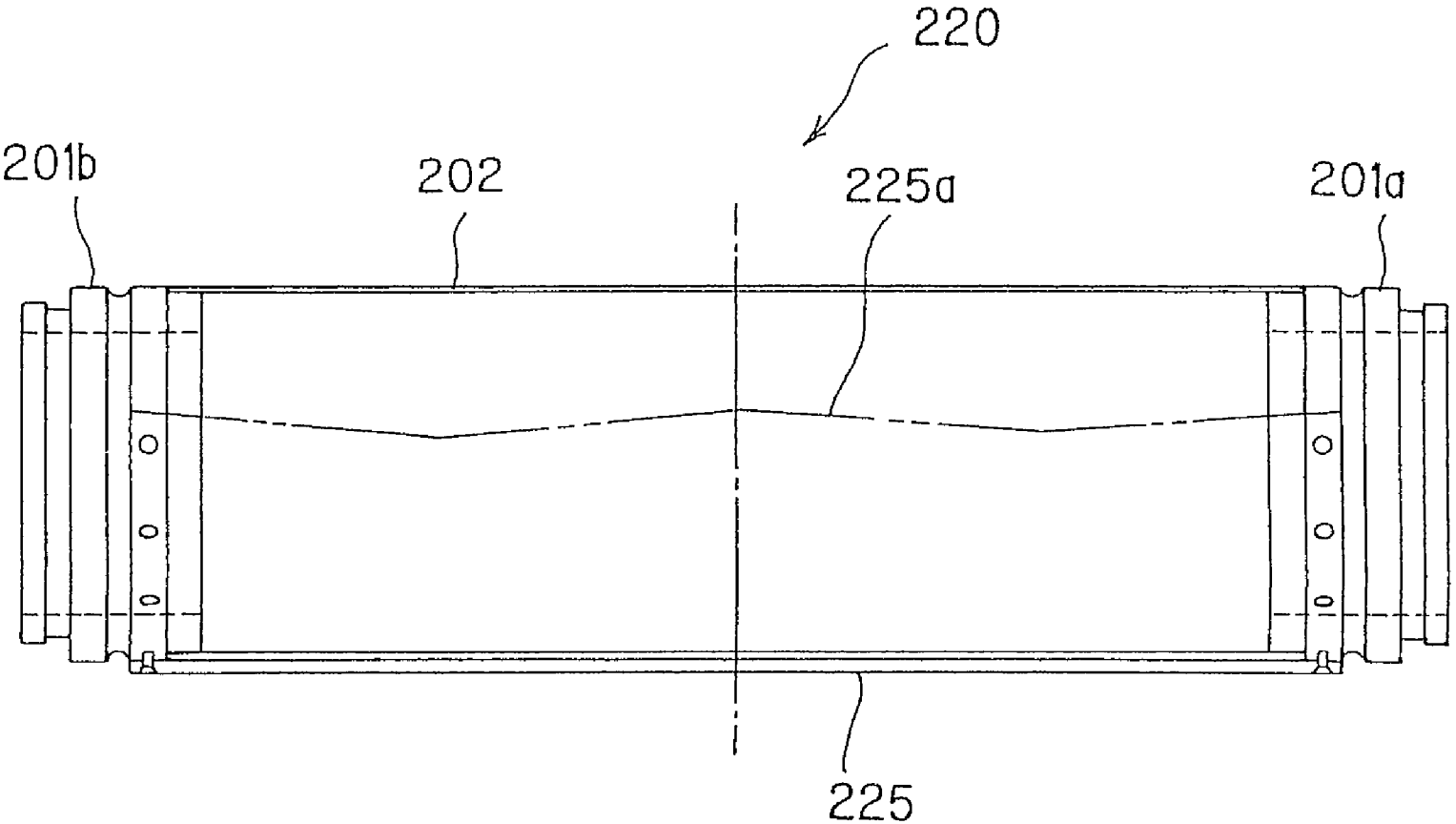
FIG. 10 shows a cross-sectional view in terms of an axial direction of a substantial part of a rotary screen cylinder of still another embodiment.
Figure 11:
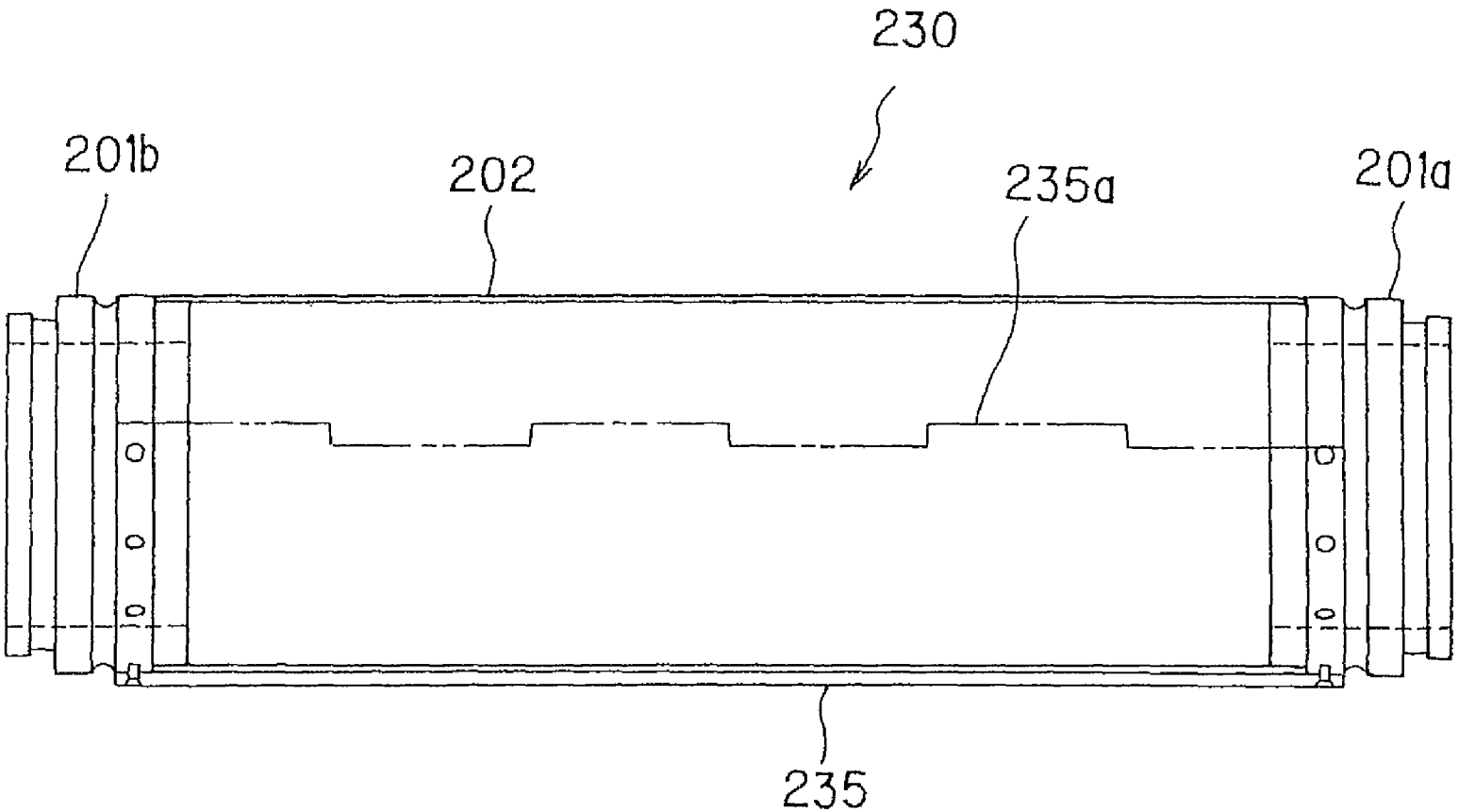
FIG. 11 shows a cross-sectional view in terms of an axial direction of a substantial part of a rotary screen cylinder of still another embodiment.

As shown in FIGS. 3 to 5, in the above-described embodiment, the boundaries 100*c* and 100*e* between the step portions 100*b* and 100*d*, and, the outer peripheral surface of the gap 101*a* of the impression cylinder 100 are set to incline straight to the direction of the shaft center while the end portions 205*a* and 205*b* of the guard 205 of the rotary screen apparatus 200 are set to incline straight to the direction of the shaft center of the screen 202 so as to correspond to the shapes of the gap 101*a* and of the boundaries 100*c* and 100*e* of the impression cylinder 100, so the squeegee 204 oriented along the direction of the shaft center is movably supported by both of the outer peripheral surface of the impression cylinder and the guard 205 simultaneously and temporarily. However, in another embodiment, it is also possible to apply a rotary screen apparatus 210 including a guard 215 having an end portion 215*a* formed substantially into a V-shape as shown in FIG. 9, for example, in a way that the length in the circumferential direction will decrease as a point approaches the center of the screen 202 in the shaft center direction. Here, in accordance with the shape of the end portion 215*a* of the guard 215 of the rotary screen apparatus 210, a gap and boundaries of the impression cylinder are also formed substantially into a V-shape in a way that the length in the circumferential direction will increase as a point approaches the center of the impression cylinder in the shaft center direction. In addition, in still another embodiment, it is also possible to apply a rotary screen apparatus 220 including a guard 225 having an end portion 225*a* formed substantially into a W-shape as shown in FIG. 10, for example, in a way that the length in the circumferential direction gradually decreases as a point separates from the center and from the both ends in the direction of the shaft center of the screen 202. Here, in accordance with the shape of the end portion 225*a* of the guard 225 of the rotary screen apparatus 220, a gap and boundaries of the impression cylinder are also formed substantially into a W-shape in a way that the length in the circumferential direction of the outer peripheral surface of the impression cylinder increases as a point separates from the center and from the both ends in the direction of the shaft center. In still another embodiment, it is also possible to apply a rotary screen apparatus 230 such that the end portion 235*a* of the guard 235 is formed in a patterned substantially concavo-convex shape as shown in FIG. 11, for example in a way that the length in the circumferential direction will decrease at every predetermined pitch along the direction of the shaft center of the screen 202. Here, in accordance with the shape of the end portion 235*a* of the guard 235 of the rotary screen apparatus 230, the gap and the boundaries of the impression cylinder are formed into a patterned substantially concavo-convex shape in a manner that the length in the circumferential direction of the outer peripheral surface of the impression cylinder will increase at every predetermined pitch along the direction of the shaft center. Furthermore, in yet another embodiment, it is also possible to apply a rotary screen apparatus including a guard having an end portion formed in a wave shape so as to gradually change the length in the circumferential direction at a given cycle along the direction of the shaft center of the screen. Here, in accordance with the shape of the end portion of the guard of the rotary screen apparatus, a gap and boundaries of the impression cylinder are also formed substantially in a wave shape so as to gradually change the length in the circumferential direction of the outer peripheral surface of the impression cylinder at a given cycle along the direction of the shaft center. In this way, it is also possible to movably support the squeegee 204 oriented along the direction of the shaft center by use of the outer peripheral surface of the impression cylinder and the guard 215, 225 or 235 simultaneously and temporarily.

Figure 12:
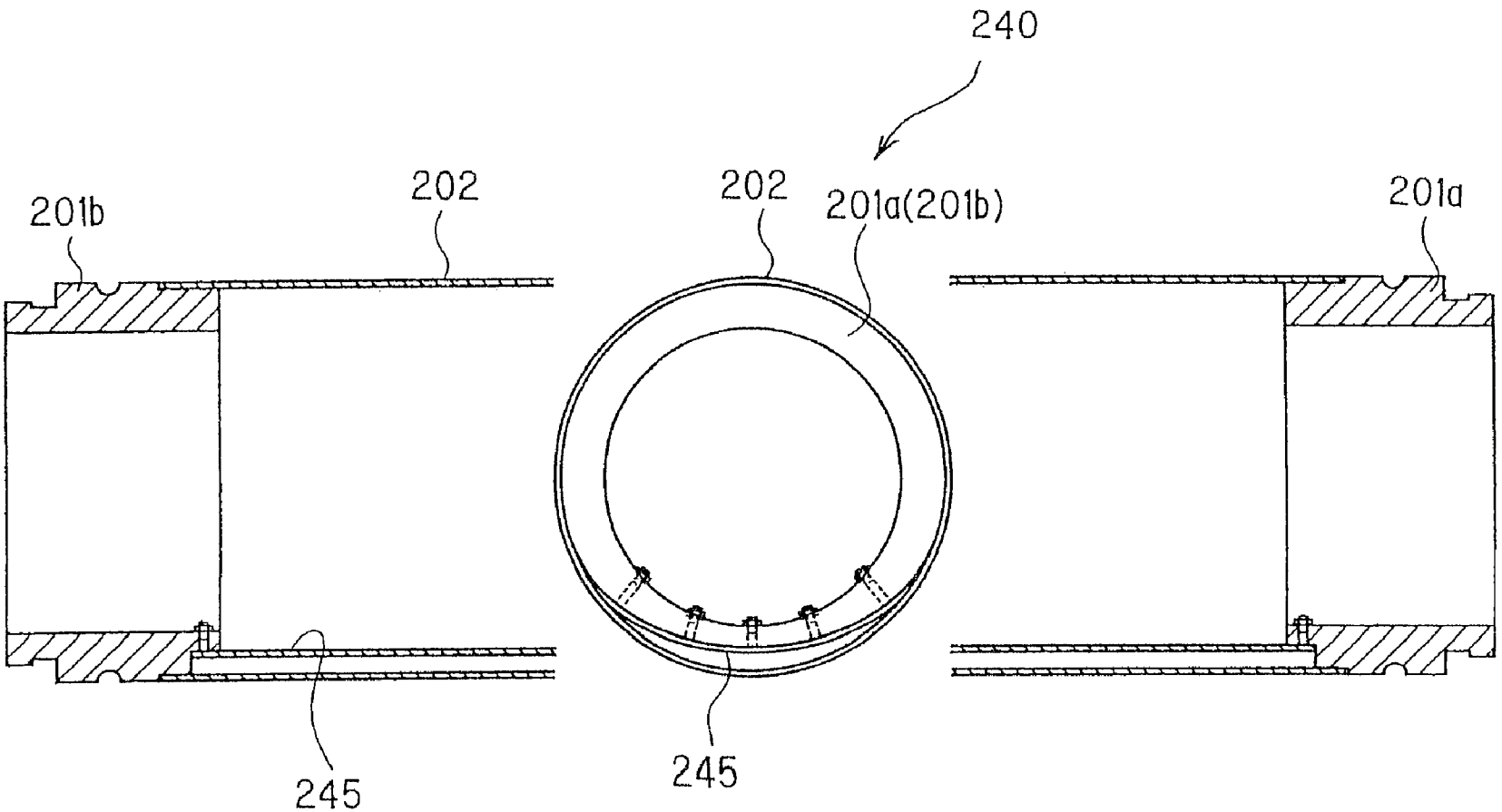
FIG. 12 shows a cross-sectional view in terms of an axial direction of a substantial part of a rotary screen cylinder of yet another embodiment.

Moreover, the above-described embodiment explains the case of supporting the rotary screen cylinder of the rotary screen apparatus 200 provided with the guard 205 on the outer surface side of the screen 202. However, the present invention is applicable as similar to the above-described embodiment to a case of supporting a rotary screen cylinder of a rotary screen apparatus 240 provided with a guard 245 on an inner surface side of a screen 202 as shown in FIG. 12, for example, or to a case of supporting a rotary screen cylinder of a rotary screen apparatus without a guard.

Meanwhile, the gripper pads 101, the gripper shaft 102, the grippers 103, and the like collectively constitute the sheet holding means in the above-described embodiment. In another embodiment, it is also possible to construct the sheet holding means by use of a suction holder placed at a gap on an outer peripheral surface of an impression cylinder and provided with a suction port on a surface thereof as disclosed, for example, in Japanese Unexamined Patent Publication No. 2001-225445, suction means to be connected to this suction holder, and suction holding means including switching means provided between the suction holder and the suction means for opening a space between the suction holder and the suction means when receiving a sheet and for shutting off the space between the suction holder and the suction means when passing the sheet.

Moreover, in the above-described embodiment, the second driving means includes the shaft 307, the levers 308, the pins 309, the rods 310, the pins 311, the pin 312, the driving rod 313, the inter-shaft motor 314, and the like. However, in another embodiment, as disclosed in Japanese Unexamined Utility Model Publication No. 2(1990)-9534, for example, it is also possible to construct the second driving means by providing the flange 301*a* of the first eccentric bearing 301 with a sector gear (16) instead of the pins 309 and 311 and the rod 310, providing a lever (18) that includes a sector gear portion (17) to be meshed with the sector gear (16) instead of the levers 308, and providing the lever (18) with fluid pressure cylinders (20*a* and 20*b*) that connect tip portions of a piston rod (21) through pins (22) instead of the pin 312, the driving rod 313 and the inter-shaft motor 314.

Furthermore, in the above-described embodiment, the first eccentric bearings 301 are allowed to slide and travel in the direction of the shaft center along with the rotation of the adjusting screw 303, by screwing the adjusting screw 303 into the frame 1000 and by sandwiching the head 303*a* of the adjusting screw 303 with the pair of flanges 303*b* while loosely fitting the head 303*a* into the long holes on the flanges 301*a* of the first eccentric bearings 301. In another embodiment, for example, it is also possible to allow the first eccentric bearings 301 to slide and travel in the direction of the shaft center along with rotation of the adjusting screw 303 by screwing the adjusting screw into the flanges of the first eccentric bearings, forming long holes on the frame, and sandwiching the adjusting screw with the pair of flanges 303*b* while loosely fitting the head of the adjusting screw into the long holes.

Figure 13:
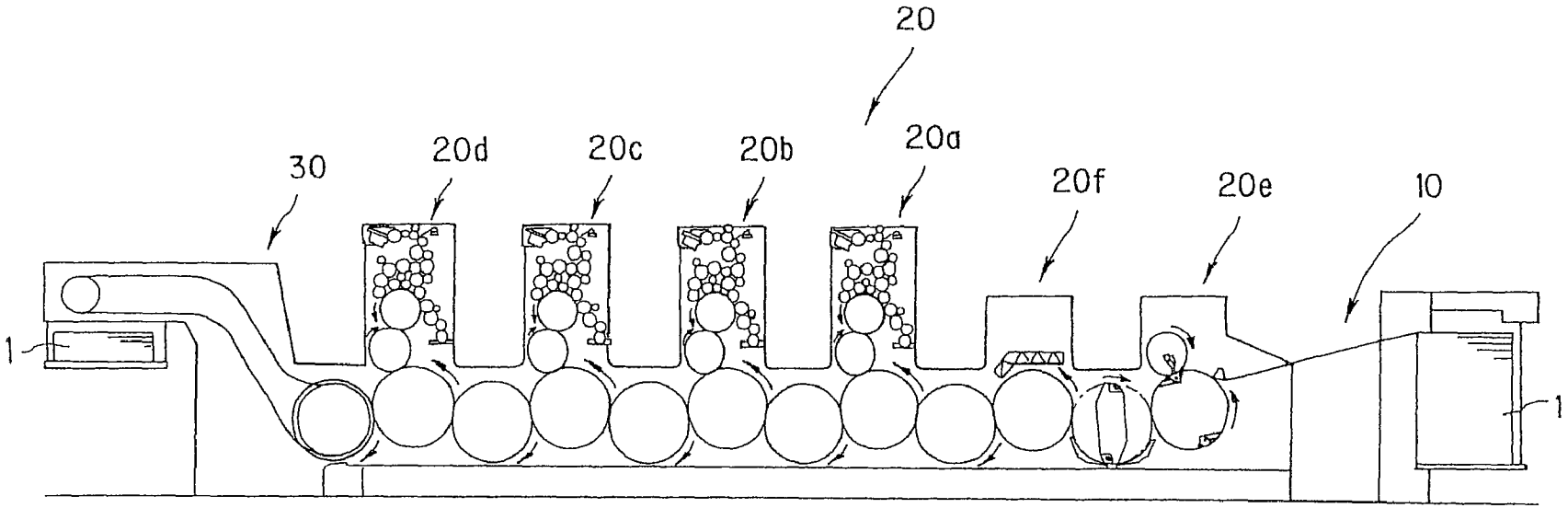
FIG. 13 shows an overall schematic structural drawing showing a printing press of another embodiment, which applies the cylindrical body supporting device of the present invention in order to support a rotary screen cylinder of a rotary screen apparatus in a screen printing unit.
Figure 14:
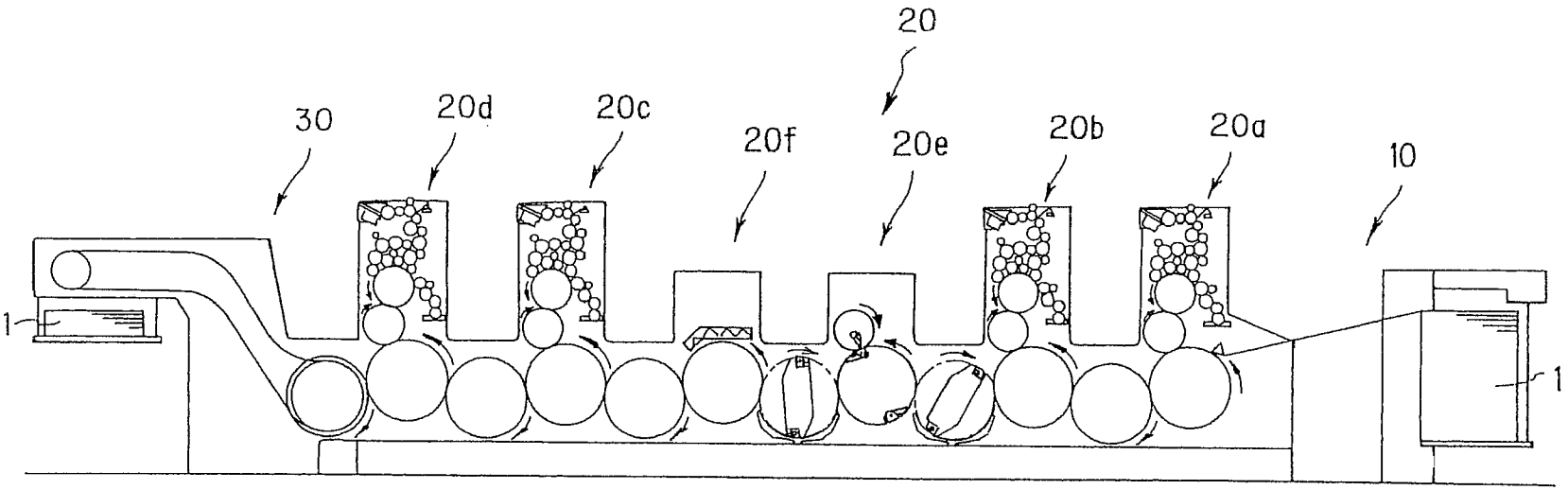
FIG. 14 shows an overall schematic structural drawing showing a printing press of still another embodiment, which applies the cylindrical body supporting device of the present invention in order to support a rotary screen cylinder of a rotary screen apparatus in a screen printing unit.

Meanwhile, in the above-described embodiment, the screen printing unit 20*e* and the drying unit 20*f* are disposed on the downstream side of the first to fourth offset printing units 20*a* to 20*d*. Instead, it is also possible to dispose the screen printing unit 20*e* and the drying unit 20*f* on the upstream side of the first to fourth offset printing units 20*a* to 20*d* as shown in FIG. 13, for example. Alternatively, it is also possible to dispose the screen printing unit 20*e* and the drying unit 20*f* between the pair of the first and second offset printing unit 20*a* and 20*b* and the pair of the third and fourth offset printing units 20*c* and 20*d* as shown in FIG. 14, for example.

Figure 15:
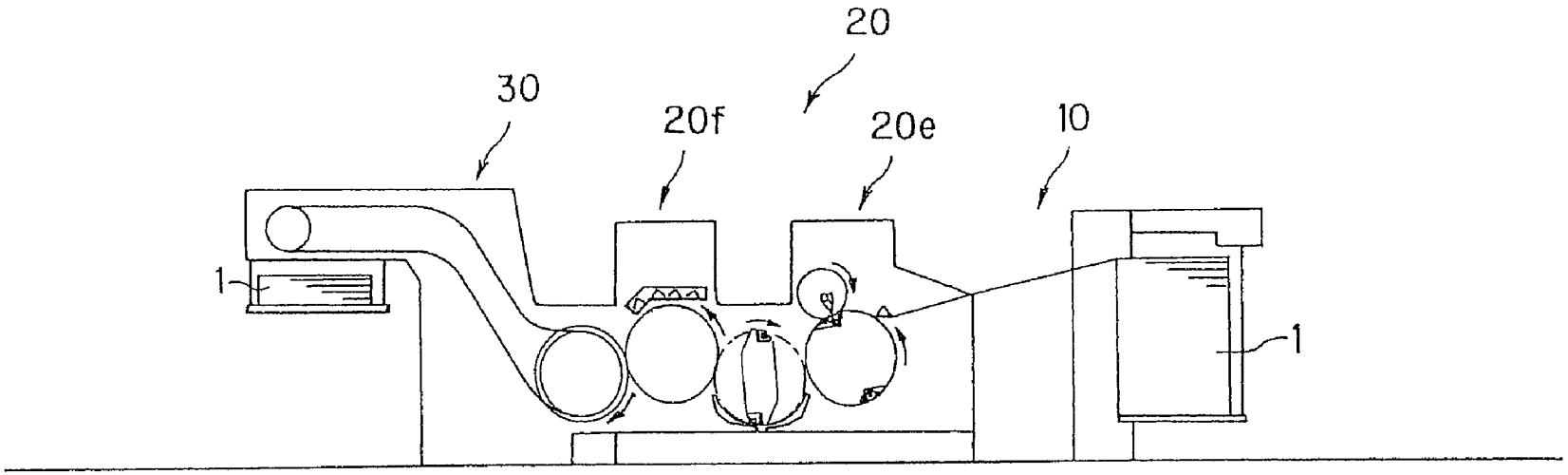
FIG. 15 shows an overall schematic structural drawing showing a printing press of yet another embodiment, which applies the cylindrical body supporting device of the present invention in order to support a rotary screen cylinder of a rotary screen apparatus in a screen printing unit.

Moreover, the above-described embodiment describes the case of applying the present invention to the printing press which combines the offset printing units 20*a* to 20*d* and the screen printing unit 20*e*. Instead, it is also possible to apply the present invention to a screen printing press which includes the feeder 10, the screen printing unit 20*e*, the drying unit 20*f*, and the delivery unit 30 and which doesn't include any offset printing units as shown in FIG. 15, for example. Alternatively, it is also possible to combine the present invention and an processing unit such as a rotary punching machine, which is different from a printing unit.

Meanwhile, the above-described embodiment describes the case of applying the present invention to the screen printing unit 20*e* configured to store the special ink inside the screen 202 of the rotary screen apparatus 200 and to perform thick printing of the special ink 2 from the small holes on the screen 202 onto the flat paper sheet 1 by use of the squeegee 204. However, the present invention is not limited only to the foregoing configuration. For example, the present invention can be also utilized as a coating device configured to put varnish inside a screen of a rotary screen apparatus and to perform coating of the varnish from small holes on the screen onto a flat paper sheet by use of a squeegee. As shown in this example, the present invention is applicable to a case of supplying a liquid from holes on a plate material of a rotary screen apparatus to a sheet held on an impression cylinder by use of a squeegee, as is similar to the above-described first embodiment.

Moreover, the above-described embodiment explains an example of application in order to support the rotary screen cylinder of the rotary screen apparatus 200 in the screen printing unit 20*e* of the printing press. However, the present invention is not limited only to this configuration. For example, the present invention is applicable, in the similar fashion to the above-described embodiment, not only to a supporting device for supporting a plate cylinder of a printing press, but also to any cases of drivably and rotatably supporting a cylindrical body.

According to the cylindrical body supporting device of the present invention, it is possible to adjust a delicate deviation in a position of a cylindrical body easily. Therefore, it is possible to perform register adjustment in terms of a position of the rotary screen cylinder, when the present invention is employed, for example, to support a rotary screen cylinder of a rotary screen apparatus configured to perform screen printing on flat paper sheets.

A cylindrical body supporting device according to the present invention can adjust a delicate deviation in terms of a position of a rotating body easily. Therefore, when the present invention is applied in order to support a rotary screen cylinder of a rotary screen apparatus configured to perform screen printing on flat paper sheets, for example, it is possible to perform register adjustment in terms of a position of a screen on the rotary screen apparatus. Accordingly, the present invention is extremely useful in the printing industry and the like.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cylindrical body supporting device, comprising:

a pair of supporting members for respectively supporting both end sides in an axial direction of a cylindrical body;

a pair of first driving means for respectively moving the pair of supporting members along the axial direction; and controlling means for activating the pair of first driving means to allow the pair of supporting members to move approaching and receding along the axial direction and thereby to support and release the cylindrical body and for activating the pair of first driving means to synchronously move the pair of supporting members in an identical amount in the same direction along the axial direction in a state of supporting the cylindrical body and thereby to move the cylindrical body in the axial direction.

2. The cylindrical body supporting device according to claim 1, further comprising:

a pair of first bearing members for rotatably supporting the pair of supporting members respectively, wherein the first driving means moves the supporting members along the axial direction through the first bearing members.

3. The cylindrical body supporting device according to claim 1, wherein the cylindrical body is a rotary screen cylinder.

4. A cylindrical body supporting device, comprising:

a pair of supporting members for respectively supporting both end sides in an axial direction of a cylindrical body;

a pair of first driving means for respectively moving the pair of supporting members along the axial direction;

controlling means for activating the pair of first driving means to allow the pair of supporting members to move approaching and receding along the axial direction and thereby to support and release the cylindrical body and for activating the pair of first driving means to synchronously move the pair of supporting members in an identical amount in the same direction along the axial direction in a state of supporting the cylindrical body and thereby to move the cylindrical body in the axial direction; and a pair of first bearing members for rotatably supporting the pair of supporting members respectively, wherein the first driving means moves the supporting members along the axial direction through the first bearing members, and wherein the first bearing members are configured to support the supporting members eccentrically, and the cylindrical body supporting device further comprises second driving means for rotationally moving the first bearing members in a circumferential direction.

5. The cylindrical body supporting device according to claim 4, further comprising:

a second bearing member for eccentrically supporting one out of the pair of first bearing members; and third driving means for rotationally moving the second bearing member in a circumferential direction.

6. A cylindrical body supporting device, comprising:

a pair of supporting members for respectively supporting both end sides in an axial direction of a cylindrical body;

a pair of first driving means for respectively moving the pair of supporting members along the axial direction;

controlling means for activating the pair of first driving means to allow the pair of supporting members to move approaching and receding along the axial direction and thereby to support and release the cylindrical body and for activating the pair of first driving means to synchronously move the pair of supporting members in an identical amount in the same direction along the axial direction in a state of supporting the cylindrical body and thereby to move the cylindrical body in the axial direction;

a power transmission member provided on one out of the pair of supporting members so as to regulate rotation in a circumferential direction relative to the supporting member and to enable motion in an axial direction and provided with helical teeth to be meshed with a helical gear on an outer peripheral surface; and fourth driving means for moving the power transmission member meshed with the helical gear in the axial direction.

7. The cylindrical body supporting device according to claim 6, wherein the fourth driving means comprises:

a carrier member of which one end is fitted to the power transmission member;

a screw shaft of which one end is supported in a rotational and movable manner by the carrier member;

a worm wheel provided with a screw portion on an inner peripheral surface, into which the screw shaft is screwed;

a worm meshed with the worm wheel; and a circumferential motor for rotating the worm.

8. A cylindrical body supporting device, comprising:

a pair of supporting members for respectively supporting both end sides in an axial direction of a cylindrical body;

a pair of first driving means for respectively moving the pair of supporting members along the axial direction;

controlling means for activating the pair of first driving means to allow the pair of supporting members to move approaching and receding along the axial direction and thereby to support and release the cylindrical body and for activating the pair of first driving means to synchronously move the pair of supporting members in an identical amount in the same direction along the axial direction in a state of supporting the cylindrical body and thereby to move the cylindrical body in the axial direction; and a pair of first bearing members for rotatably supporting the pair of supporting members respectively, wherein the first driving means moves the supporting members along the axial direction through the first bearing members, and wherein the first driving means comprises:

an adjusting screw screwed into any one of the frame and the supporting member and loosely fitted to another one of the frame and the supporting member so as to regulate motion in an axial direction relative to the other one of the frame and the supporting member; and a lateral motor for rotationally moving the adjusting screw.

9. The cylindrical body supporting device according to claim 8, wherein the adjusting screw is provided with a head to be loosely fitted to the supporting member and is restricted to move in the axial direction relative to the supporting member while being screwed into the frame, the first driving means comprises a spur gear fitted coaxially to the head of the adjusting screw, and a spline gear of a spur type engaged with the spur gear, and the lateral motor is connected to the spline gear and is fixed to and supported by the frame.

10. A cylindrical body supporting device, comprising:

a pair of supporting members for respectively supporting both end sides in an axial direction of a cylindrical body;

a pair of first driving means for respectively moving the pair of supporting members along the axial direction;

controlling means for activating the pair of first driving means to allow the pair of supporting members to move approaching and receding along the axial direction and thereby to support and release the cylindrical body and for activating the pair of first driving means to synchronously move the pair of supporting members in an identical amount in the same direction along the axial direction in a state of supporting the cylindrical body and thereby to move the cylindrical body in the axial direction; and second driving means for moving the cylindrical body and thereby adjusting an inter-shaft distance between the cylindrical body and a cylinder opposing the cylindrical body.

11. A cylindrical body supporting device, comprising:

a pair of supporting members for respectively supporting both end sides in an axial direction of a cylindrical body;

a pair of first driving means for respectively moving the pair of supporting members along the axial direction;

controlling means for activating the pair of first driving means to allow the pair of supporting members to move approaching and receding along the axial direction and thereby to support and release the cylindrical body and for activating the pair of first driving means to synchronously move the pair of supporting members in an identical amount in the same direction along the axial direction in a state of supporting the cylindrical body and thereby to move the cylindrical body in the axial direction; and second driving means for moving one of the pair of supporting members with respect to the other one thereof and thereby adjusting an amount of oblique deviation in the cylindrical body.

12. A cylindrical body supporting device, comprising:

a pair of supporting members for respectively supporting both end sides in an axial direction of a cylindrical body;

a pair of first driving means for respectively moving the pair of supporting members along the axial direction;

controlling means for activating the pair of first driving means to allow the pair of supporting members to move approaching and receding along the axial direction and thereby to support and release the cylindrical body and for activating the pair of first driving means to synchronously move the pair of supporting members in an identical amount in the same direction along the axial direction in a state of supporting the cylindrical body and thereby to move the cylindrical body in the axial direction; and second driving means for rotatably moving the cylindrical body in a circumferential direction thereof and thereby adjusting a position of the cylindrical body in the circumferential direction.

* * * * *